US007022054B2

(12) United States Patent
Contreras

(10) Patent No.: US 7,022,054 B2
(45) Date of Patent: Apr. 4, 2006

(54) LEG-STRETCHING DEVICE AND METHOD

(76) Inventor: Isaiah G. Contreras, P.O. Box 18406, Anaheim, CA (US) 92817

( * ) Notice: Subject to any disclaimer, the term of this patent is extended or adjusted under 35 U.S.C. 154(b) by 393 days.

(21) Appl. No.: 10/611,124

(22) Filed: Jul. 1, 2003

(65) Prior Publication Data

US 2004/0029689 A1 Feb. 12, 2004

Related U.S. Application Data

(60) Provisional application No. 60/393,062, filed on Jul. 1, 2002.

(51) Int. Cl.
*A61H 1/02* (2006.01)
*A63B 21/002* (2006.01)

(52) U.S. Cl. ..... 482/131; 482/79; 482/91; 482/907

(58) Field of Classification Search ..... 482/23, 482/24, 34, 79, 91, 92, 95, 96, 131, 132, 482/143, 907; 601/35; D21/673
See application file for complete search history.

(56) References Cited

U.S. PATENT DOCUMENTS

| | | | | |
|---|---|---|---|---|
| 3,117,782 A | * | 1/1964 | Johnston | 482/95 |
| 4,205,839 A | * | 6/1980 | Best | 482/131 |
| 4,277,062 A | | 7/1981 | Lawrence | |
| 4,411,426 A | * | 10/1983 | McCoy et al. | 482/131 |
| 4,988,096 A | * | 1/1991 | Jones | 482/94 |
| 5,067,709 A | * | 11/1991 | Christianson | 482/95 |
| 5,261,865 A | * | 11/1993 | Trainor | 482/95 |
| 5,324,245 A | * | 6/1994 | Fontana et al. | 482/131 |
| 5,405,306 A | | 4/1995 | Goldsmith et al. | |
| 5,407,411 A | * | 4/1995 | Trainor | 482/95 |
| 5,885,190 A | * | 3/1999 | Reiter | 482/69 |
| 6,110,083 A | * | 8/2000 | Riser | 482/142 |
| 6,113,564 A | * | 9/2000 | McGuire | 602/32 |

FOREIGN PATENT DOCUMENTS

| | | |
|---|---|---|
| DE | 296 06 156 | 6/1995 |
| WO | WO 2005009319 A1 * | 2/2005 |

OTHER PUBLICATIONS

International Search Report mailed Sep. 8, 2004.

* cited by examiner

*Primary Examiner*—Jerome W. Donnelly
*Assistant Examiner*—Victor K. Hwang
(74) *Attorney, Agent, or Firm*—Knobbe, Martens, Olson & Bear, LLP

(57) ABSTRACT

Disclosed is a device to aid in spreading a person's legs to increase the flexibility of the groin and thigh muscles. The device employs a bar having a central curved segment that engages the lower back region. Each end of the bar has a pulley through which a cord extends with a handgrip and a stirrup at opposite ends of the cord. The user sits on the floor and places their feet through the respective stirrups, and pulls on the handgrips which pull the feet to spread the legs.

14 Claims, 5 Drawing Sheets

LEG-STRETCHING DEVICE AND METHOD

PRIORITY INFORMATION

This application claims the priority benefit under 35 U.S.C. § 119(e) of Provisional Application No. 60/393,062 filed Jul. 1, 2002.

FIELD OF THE INVENTION

This invention relates generally to an exercise device as an aid in the stretching and strengthening of the groin and thigh muscles. While the device allows for everyday use, it is specifically targeted toward the development of an athlete's legs.

BACKGROUND OF THE INVENTION

Stretching of the muscles has been found to be an important part of one's physical health. In particular, athletic performance is closely tied to one's flexibility. Flexibility of the muscles prevents injuries such as pulled and strained muscles. At the same time, increased flexibility allows for improved performance such as longer strides during running and increased height during kicking movements. Typically dancers, athletes and martial artists require the aid of partners to help stretch the leg muscles. These individuals and others that exert themselves physically rely on the stability of their muscles for improved performance. Increased flexibility aids in athletic performance and improves overall cardiovascular health.

There exists a need for a device to aid in the flexibility of the lower torso muscles, particularly the groin and thigh muscles.

SUMMARY OF THE INVENTION

Briefly stated the invention provides a device that allows a person to sit on the floor and stretch the leg muscles primarily through the pulling of handgrips connected by cords to ends of a bar. The bar has a center segment, preferably curved, that engages and supports the user's back. The user's feet are placed into a pair of footgrips or stirrups connected to the opposite ends of the cords. By pulling on the handgrips, the user produces a force that spreads the legs. Another embodiment provides pivots or pulleys with locks on the ends of the bar to allow the cords to be locked in a desired position. Such a locking mechanism allows the legs to remain in the stretched position without the user having to exert arm strength in holding the cords in the stretched position. The cords are unlocked by pushing the handgrips forward and away from the user's body.

DETAILED DESCRIPTION OF THE PREFERRED EMBODIMENT

Figure 1:
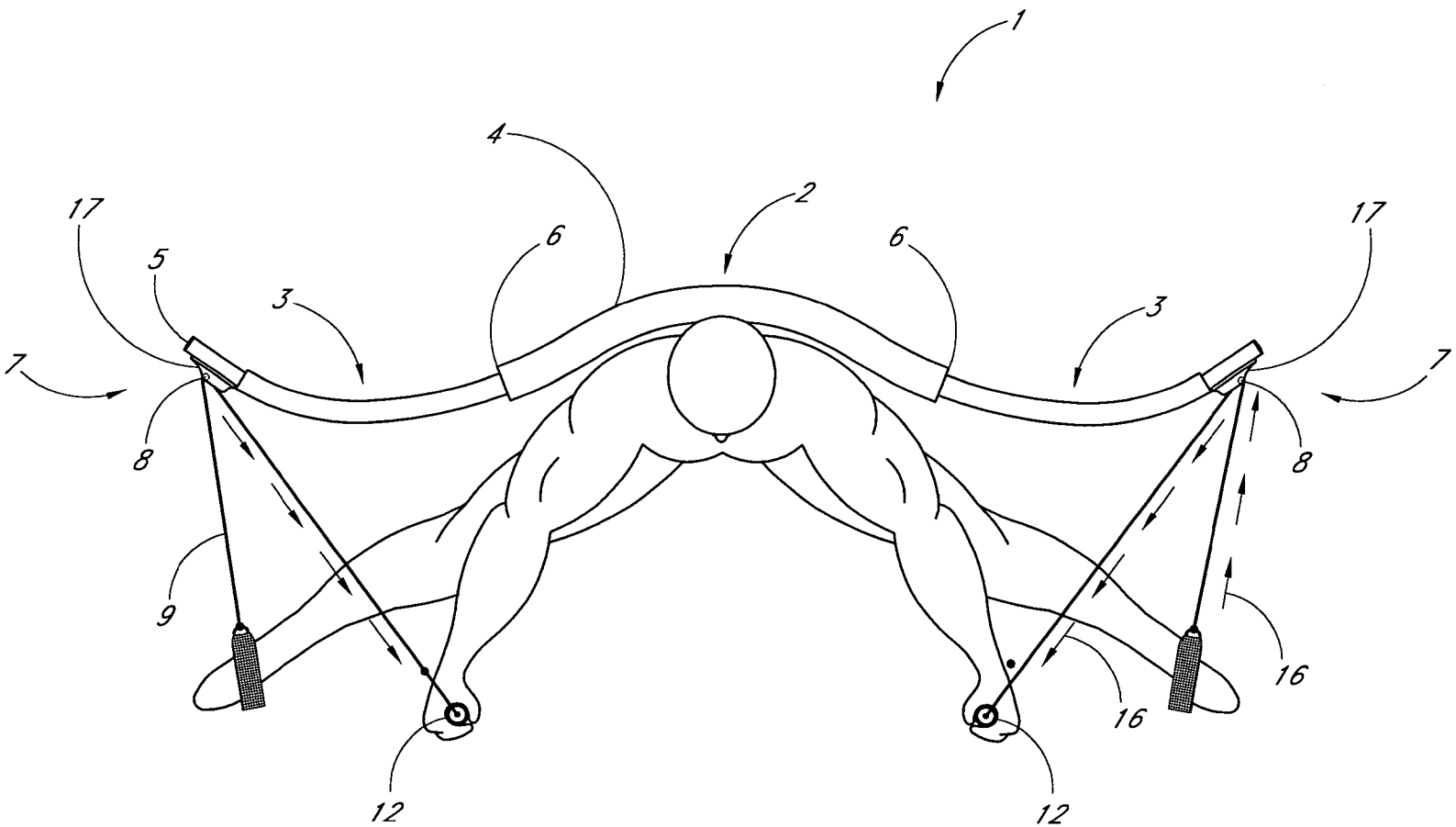
FIG. 1 depicts an overhead view of one embodiment of the invention in its operational state.

FIG. 1 depicts an embodiment of a leg-stretching device in its operational state. A person desiring to increase the flexibility of their groin and lower leg muscles sits on a floor or other stable and preferably flat surface. In this embodiment the bar 1 is composed of three segments or curved portions, but any number of curved segments could be used, as well as straight or curved segments alone or in combination. As such, the bar includes two similarly curved end segments 3 and an oppositely curved center segment 2 aligned against the person's lower back.

The bar 1 is preferably composed of inflexible materials such as aluminum, steel, or various other materials capable of withstanding strong pressures exerted from the exercise. The bar 1 may be constructed by shaping a solid or hollow cylinder to a curved shape conforming to various dimensions. Preferably, the three curved segments have the same radius of curvature.

Figure 5:
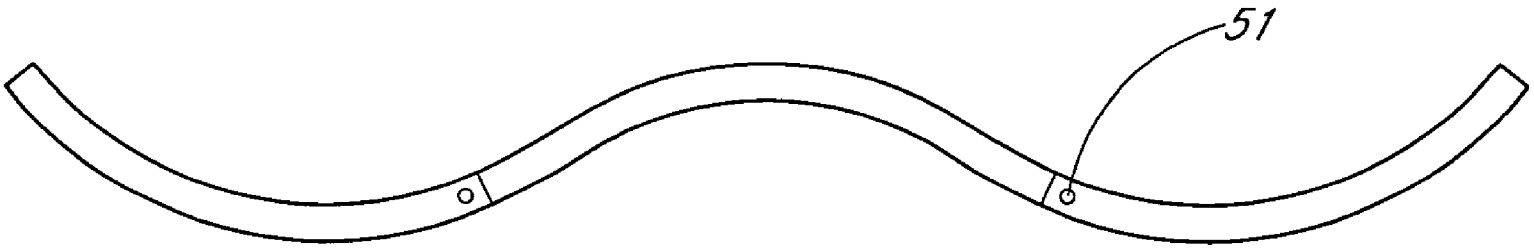
FIG. 5 shows an embodiment of the curved bar with a hinged design.

Another embodiment may be constructed using separate pieces for each segment of the bar 1 as opposed to one continuous piece. The segments of the bar 1 may be welded or otherwise fastened together to form one bar 1. Alternatively the segments may be attached through hinge-like structures 51 as shown in FIG. 5. A preferred location for the hinges 51 is the tangential connection 6 between the curved segments. The tangential connection 6 is the location where the curvature of the curved segment 2 transitions to the oppositely curved end segments 3. On FIG. 1, this location is exemplified approximately by the point where the support 4 terminates near the ends of the center segment. The hinges 51 allow the segments of the bar 1 to be folded in a compact structure to allow for ease of transport and storage.

Preferably a padded support 4 is located against the portion of the bar 1 that rests against the person's back. The support 4 can be composed of conventional foam materials. The support 4 may also extend to the end segments 3 of the bar 1. Further, there may exist a plurality of supports 4 aligned over each other or separated from each other along the length of the bar 1. Likewise, a combination of such configurations may exist. The bar 1 illustrated is hollow, and barcaps 5 cover the open ends of the bar. To create softer and safer edges, the barcaps 5 may be composed of plastic or other soft and durable materials.

Referring again to FIG. 1, a pair of pivots 7 is shown, one on each end of the bar. The pivot 7 is intended to cover a structure that captures a cord 9 while permitting the cord 9 to be moved endwise through the pivot 7. The pivots 7 may be constructed within the bar 1 itself or preferably attached to the outside of the bar 1. The pivots 7 may be attached through the use of suitable fasteners such as rivets, screws, bolts or other similar pieces. Similarly, the pivots 7 may be attached through the used of chemical fasteners such as glue, cement, putty and other such chemicals. Preferably the pivots 7 include rotatable mounted pulleys 8 that allow the cord 9 to be easily moved. While a pulley 8 is preferred, a stationary pivot 7 such as a ring or hook could also be employed. The pivot 7 could also be located within the bar 1. For example, two holes in the bar 1 may be located adjacent each other with the holes serving as a stationary pivot 7. Similarly, a pulley 8 may be located partially or entirely within the bar 1 rather than being mounted to a bracket 17 on the exterior of the bar 1 as shown.

Cords 9 may be composed of different materials or a combination of different materials, such as ropes, chains, thread, wire, and synthetic and natural materials. The cords 9 may be surrounded with a plastic covering to protect the cords 9 from wear and tear through prolonged use of the device. The cord 9 may be constructed of various lengths to adjust for taller and shorter users. In a preferred embodiment, the cord 9 measures thirty-four inches from the handlegrip 12 end to the stirrup 10 end.

Figure 3:
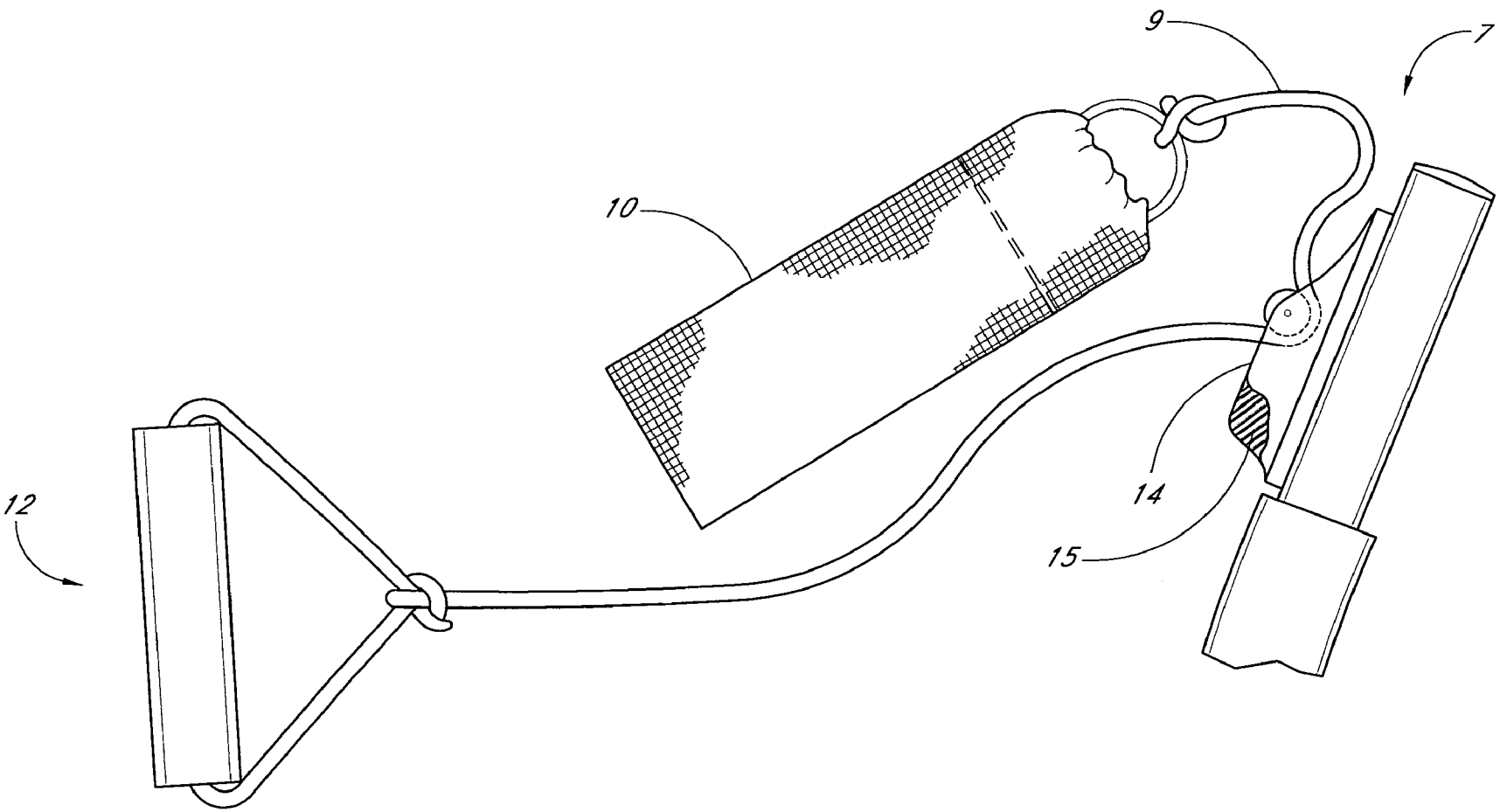
FIG. 3 is a schematic view of one end of the bar of FIG. 1 showing a footgrip and ring arrangement as well as the cord in the unlocked position.
Figure 4:
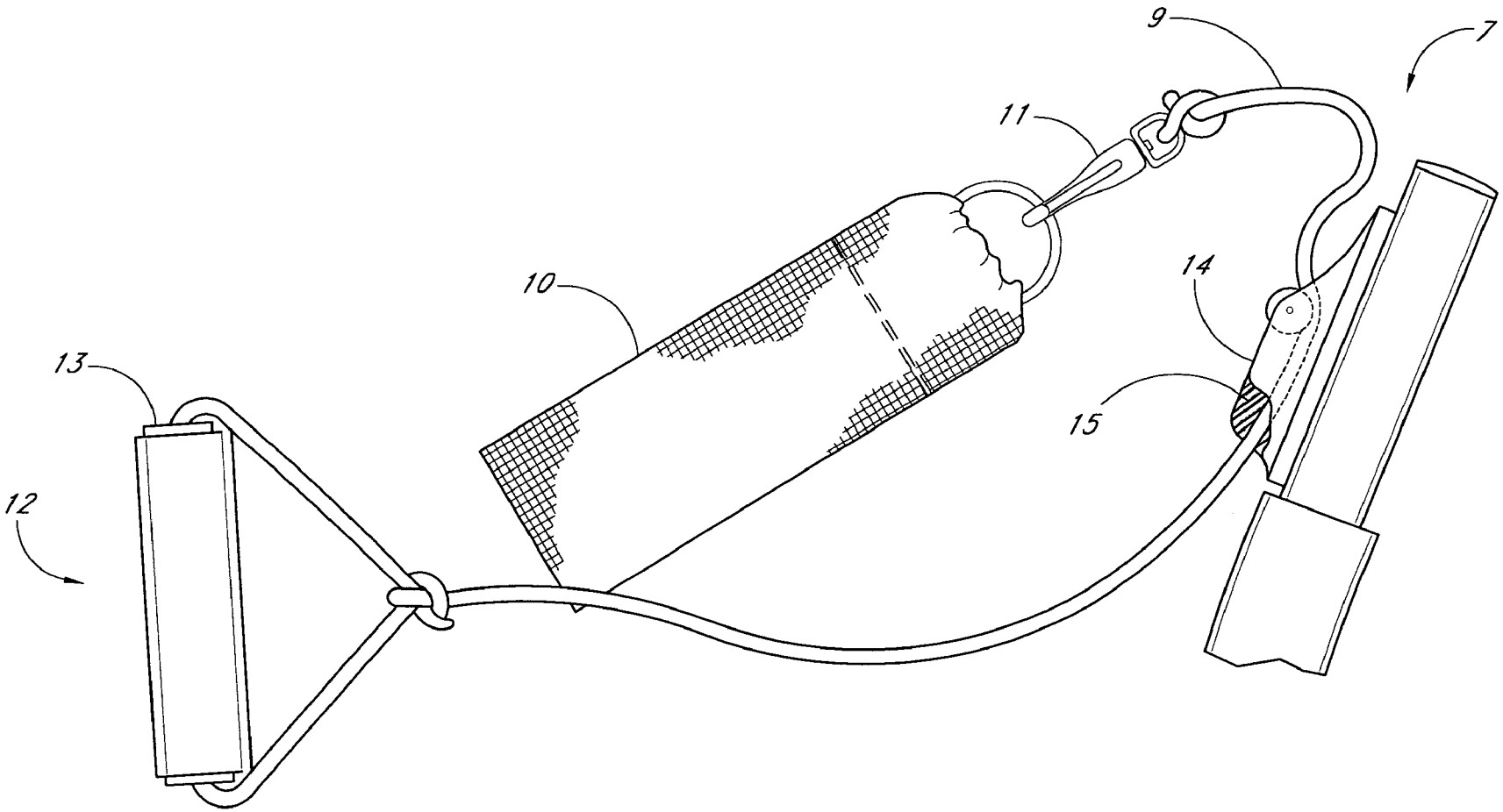
FIG. 4 shows a detailed view of one bar end of one embodiment.

Attached to one end of the cord 9 is a footgrip or stirrup 10. As shown in FIG. 3, the cord 9 may be directly attached to the stirrup 10, or, as shown in FIG. 4, to an intermediate connector 11 in the form of a swivel hook which connects the cord 9 to the stirrup 10. Such a connector 11 allows for different rotational configurations for the stirrup 10. In other embodiments, alternative stirrup 10 shapes may be used to provide specific forces to the foot to allow the legs to be spread in different directions. Such different shapes would allow the user to adjust the point of strain along the groin and leg muscles.

Attached to opposite ends of the cords are handgrips 12. Generally the handgrips 12 are composed of cylindrical units that are easily held by a user's hands. The handgrips 12 may be composed of plastic, wood, foam, or other conventional materials. Similarly, the handgrips 12 may be covered with a padded material to protect the user's hands from irritation. As shown with the stirrups 10, the handgrips 12 may also be attached to the cord 9 through an intermediate connector 11 such as a swivel hook. The handgrips 12 may be composed of hollow or solid materials. In one embodiment, as shown in FIG. 4, the ends of the handgrips 12 are covered with caps 13 having an aperture through which the cord 9 may extend. FIG. 3 shows an embodiment lacking such caps 13.

The pivots 7 may contain cord 9 locking mechanisms 14. One embodiment of the locking mechanisms 14 is seen in a cutaway view in FIG. 3. The lock 14 serves to hold the cord 9 in a substantially fixed position. The locks 14 are particularly useful for holding the legs apart during operation in an extended position. Use of the locks 14 allows the user to stretch the legs while leaving the hands free from having to work to hold the handgrips 12 in an extended position. The locks 14 are preferably composed of grooves 15 located along the interior of the pivot 7. As shown in FIG. 4, one embodiment shows the locks 14 in alignment with the pulley 8 such that the cord 9 is gripped by pulling of the cords 9 towards the bar 1. The cords 9 may thereafter be unlocked by pushing the cords 9 away from the bar 1 as in FIG. 3. In one embodiment, the locks 14 may operate in a single direction. Such a configuration would allow the user to tighten the locks 14 without first having to unlock them. Such an embodiment would allow the user to pull further on the cords 9 and increasing the stretch without having to physically remove the cords 9 from the locks 14. In such an embodiment, the locks 14 would keep the legs in a stretched position. In a preferred embodiment, the locks 14 are composed of narrowing channels that hold the cords 9 snug in between their ends.

In use of the device a user normally sits on a floor or other flat surface with the center segment adjacent the user's back, as shown. The user's feet are placed within the stirrups 10 and the user's hands grasp the handgrips 12. The legs are spread by pulling the handgrips 12 towards each other. As shown in FIG. 1, pulling the handgrips 12 causes the user's legs to extend in an outward direction. The arrows 16 show the movement of the cord 9 when the handgrips 12 are pulled together to extend the legs. The cords 9 allow for varying extensions for beginning and more experienced users. In one embodiment the cords 9 may be pulled towards the body and placed in a locked position. The locks 14 keep the legs in an extended position while allowing the hands to relax and release the handgrips 12. The cords 9 may thereafter be unlocked by pushing the handgrips 12 away from the pivots 7 and the user's body. The user may then relax the legs or thereafter reapply the tension to the cords 9 to repeat the exercise.

Figure 2:
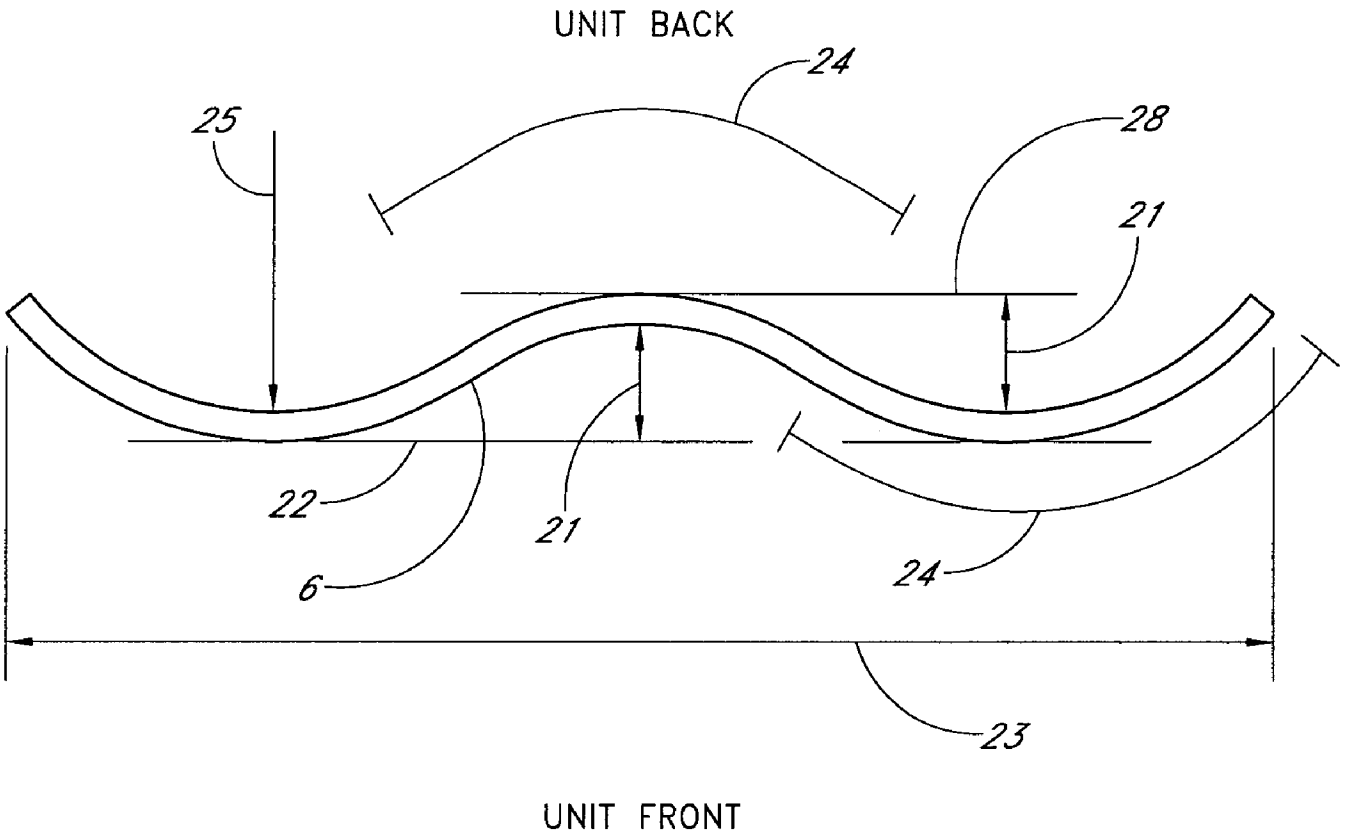
FIG. 2 depicts a plan view showing a preferred dimensional analysis of a curved bar shown in FIG. 1.

FIG. 2 represents a preferred dimensional analysis of one embodiment of the bar 1. The height 21 of the bar 1 is defined as the approximate measurement from a reference line 28 tangential to the center segment 2 and parallel to a line 22 which is a tangent to the oppositely curved outer segments 3. Preferably, the height 21 of the bar 1 is approximately five inches. The horizontal distance 23 is the measurement from one end of the bar 1 to the other end, and is preferably about 60 inches. The circumferential length 24 is defined as the distance measured along the curvature of a segment of the bar 1. The segments of the bar 1 may be divided by their tangential connections 6 for purposes of measurement. The tangential connection 6 as shown in FIGS. 1 and 2 is defined as the point where two oppositely curved segments meet and form a straight line. The preferred circumferential lengths 24 of the end segments 3 are approximately twenty-two and a half inches each. The preferred circumferential length 24 of the center segment 2 is approximately eighteen inches.

The curved bar segments preferably have a constant radius of curvature 25. All or only some of the segments of the bar 1 may have the same radius of curvature 25. The segments in FIG. 2 all have the same radial curvature 25, preferably approximately nineteen inches.

The above description is intended for purposes of illustration. Different embodiments of the invention may be carried out in other ways without departing from the spirit or scope of the invention. Modifications and variations falling within the spirit or scope of the invention will be apparent to those of skill in the art.

What is claimed is:

1. A leg-stretching device comprising:

a bar having a curved center segment to be positioned adjacent the lower back of a person using the device with end segments extending outwardly;

a pulley connected to a first end segment of the bar;

a cord extending over the pulley with a handgrip connected to one end of the cord and a stirrup connected to an opposite end of the cord; and a second pulley connected to a second end segment of the bar, a second cord extending over the second pulley, a second handgrip connected to one end of the second cord and a second stirrup connected to the opposite end of the second cord, wherein the bar center segment is configured to conform to the lower back portion of the person using the device, and wherein the bar end segments have a curvature opposite to that of the center segment.

2. The device of claim 1 comprising one or more hinges connected to the bar to enable the bar to be collapsed for handling and storage.

3. A leg-stretching device comprising:

a bar having a curved center segment between two curved end segments;

the segments all having substantially the same radius of curvature, wherein the center segment has a curvature opposing that of the two end segments;

a pivot connected to each end segment;

a cord for each end of the bar and each being movably connected to each pivot;

a handgrip connected to one end of each cord and a stirrup connected to an opposite end of each cord and arranged so that pulling on the handgrips moves the stirrups away from each other.

4. The device of claim 3 wherein each pivot comprises a pulley and each cord extend onto the pulley.

5. The device of claim 4 wherein each pivot further comprises a lock for clamping each cord to prevent movement of the cord on the pulley.

6. A leg-stretching device comprising:

a bar with a curved center segment located between two curved end segments;

the curved center segment having a tangential connection to each of the two curved end segments; and two cords, one being moveably connected to an outer end of one end segment and the other being moveably connected to an end of the other end segment; each cord having a handgrip connected to one end of the cord and a stirrup connected to an opposite end of the cord.

7. The device of claim 6 including a pulley attached to each end of the bar for receiving a respective one of said cords.

8. The device of claim 7 including a cord lock on each end of the bar.

9. A leg-stretching device comprising:

a bar having a curved center segment between two curved outer segments, the center segment having an opposing curvature to the two end segments;

each of the end segments having a longer circumferential length than the center segment;

a pivot on each of the outer curved segments; and a cord moveably connected to each pivot and having one end to be pulled by a user's hand and an opposite end to be connected to a user's foot, whereby pulling on the cords with the user's hands will provide forces to spread the user's legs.

10. The leg-stretching device of claim 9 wherein each pivot comprises a pulley and each cord is moveably connected to the pulley.

11. The leg-stretching device of claim 10 wherein each pivot further comprises a lock for holding the cord in a selected position.

12. A method for stretching a pair of legs comprising:

placing the person in a seated position on a floor;

positioning a center segment of a bar of a leg stretching device against a person's lower back with outer curved outer segments of the bar extending away from the person;

placing the person's right foot into a right stirrup which is connected to a right end of the bar through one end of a first cord moveably connected to the bar;

placing a left foot into a left stirrup which is connected to a left end of the bar through one end of a second cord;

grasping an opposite end of the first cord with the person's right hand;

grasping an opposite end of the second cord with the person's left hand; and pulling on the cords with the person's hands causing the person's feet to be spread in a leg stretching position.

13. The method of claim 12 comprising locking the cords in selected positions to hold the person's feet in a selected leg stretching position.

14. The method of claim 13 comprising unlocking the cords from the locked positions.

* * * * *